US011652313B2

(12) United States Patent
Cabañero

(10) Patent No.: US 11,652,313 B2
(45) Date of Patent: May 16, 2023

(54) SPLIT COVER ELECTRICAL CONNECTOR FOR FLAT CABLE

(71) Applicant: Lear Corporation, Southfield, MI (US)

(72) Inventor: Albert M. Cabañero, Cebu (PH)

(73) Assignee: Lear Corporation, Southfield, MI (US)

( * ) Notice: Subject to any disclaimer, the term of this patent is extended or adjusted under 35 U.S.C. 154(b) by 32 days.

(21) Appl. No.: 17/404,243

(22) Filed: Aug. 17, 2021

(65) Prior Publication Data

US 2023/0054115 A1 Feb. 23, 2023

(51) Int. Cl.

| | |
|---|---|
| ***H01R 13/46*** | (2006.01) |
| ***H01R 13/516*** | (2006.01) |
| ***H01R 12/77*** | (2011.01) |
| ***H01R 13/52*** | (2006.01) |

(52) U.S. Cl.
CPC ..... *H01R 13/516* (2013.01); *H01R 12/771* (2013.01); *H01R 13/5205* (2013.01)

(58) Field of Classification Search
CPC .. H01R 13/516; H01R 13/5205; H01R 13/46; H01R 13/518; H01R 13/52; H01R 13/5213; H01R 13/5202; H01R 12/771
USPC ..... 439/589, 465, 687, 696, 731, 906
See application file for complete search history.

(56) References Cited

U.S. PATENT DOCUMENTS 4,210,380 A * 7/1980 Brzostek ..... H01R 13/58 439/456
4,421,376 A * 12/1983 Cosmos ..... H01R 13/516 439/461
4,444,450 A * 4/1984 Huber ..... H01R 12/675 439/465
4,448,471 A * 5/1984 Berry ..... H01R 13/516 439/468
4,596,432 A * 6/1986 Tighe, Jr. ..... H01R 13/58 439/696
4,900,262 A * 2/1990 Matsuzaki ..... H01R 13/6273 439/354
5,038,000 A * 8/1991 Westbrook ..... H02G 3/18 174/563
5,171,161 A * 12/1992 Kachlic ..... H01R 12/716 439/352
5,244,415 A * 9/1993 Marsilio ..... H01R 13/65912 439/456
6,024,597 A * 2/2000 Lok ..... H01R 13/6593 439/402
6,065,993 A * 5/2000 Lai ..... H01R 13/5845 439/402
6,210,216 B1 * 4/2001 Tso-Chin ..... H01R 13/748 439/701

(Continued)

FOREIGN PATENT DOCUMENTS

GB 2289580 A 11/1995

*Primary Examiner* — Harshad C Patel
(74) *Attorney, Agent, or Firm* — MacMillan, Sobanski & Todd, LLC

(57) ABSTRACT

An electrical connector includes a housing with a housing body and a cover mount. The housing has a cable cavity that extends through the cover mount along a connector axis. The electrical connector includes a first cover. The first cover is located on the first side of the connector axis. A second cover is located on a second side of the connector axis. The first cover engages the second cover to retain the covers in their relative positions. The covers also engage the cover mount to retain their position relative to the housing.

20 Claims, 6 Drawing Sheets

(56) References Cited

U.S. PATENT DOCUMENTS

| | | | | |
|---|---|---|---|---|
| 7,815,460 | B2 * | 10/2010 | Lin | H01R 9/03 439/358 |
| 8,840,412 | B2 | 9/2014 | Ohyama et al. | |
| 9,252,526 | B2 | 2/2016 | Cho et al. | |
| 9,627,796 | B2 | 4/2017 | Tsai et al. | |
| 10,103,498 | B2 * | 10/2018 | Maesoba | H01R 13/65912 |
| 10,476,189 | B2 | 11/2019 | Tsubaki | |
| 10,665,980 | B2 * | 5/2020 | Saitoh | H02G 3/0462 |
| 2005/0020131 | A1 | 1/2005 | Beck et al. | |
| 2012/0329316 | A1 * | 12/2012 | Wu | H01R 13/6315 439/518 |

* cited by examiner

SPLIT COVER ELECTRICAL CONNECTOR FOR FLAT CABLE

BACKGROUND OF THE INVENTION

This invention relates to an electrical connector that is adapted for use with a flat flexible cable. More specifically, this invention relates to an electrical connector that is adapted to engage a seal with a flat flexible cable.

A flat flexible cable is a type of electrical cable that includes a flat, flexible base that support one or more flat electrical conductors thereon. Flat flexible cables are typically used in devices having a large amount of electronics in a relatively small space. In such devices, the flat flexible cable can provide for easier cable management than a conventional round electrical cable. It would be advantageous to have an improved electrical connector for attachment to a flat flexible cable.

SUMMARY OF THE INVENTION

The invention relates to an electrical connector. The electrical connector includes a housing. The housing has a housing body. The housing has a cover mount. The housing has a cable cavity that extends through the cover mount along a connector axis. The electrical connector includes a first cover. The first cover is located on the first side of the connector axis. A second cover is located on a second side of the connector axis. The first cover engages the second cover to retain the covers in their relative positions. The covers also engage the cover mount to retain their position relative to the housing.

In another embodiment, the electrical connector includes a housing with a housing body and a cover mount. The cover mount includes a flange and a housing groove located between the flange and the housing body. A cable cavity extends through the cover mount along a connector axis. A first cover is located on a first side of the connector axis. The first cover includes a first cover flange. A second cover is located on a second side of the connector axis. The second cover includes a second cover flange. The first cover engages the second cover to retain the first cover in position relative to the second cover. The first cover flange and the second cover flange are located at least in part in the housing groove.

Another embodiment of the electrical connector includes a cable that is located in part in the cable cavity. The cable extends between the first cover and the second cover.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
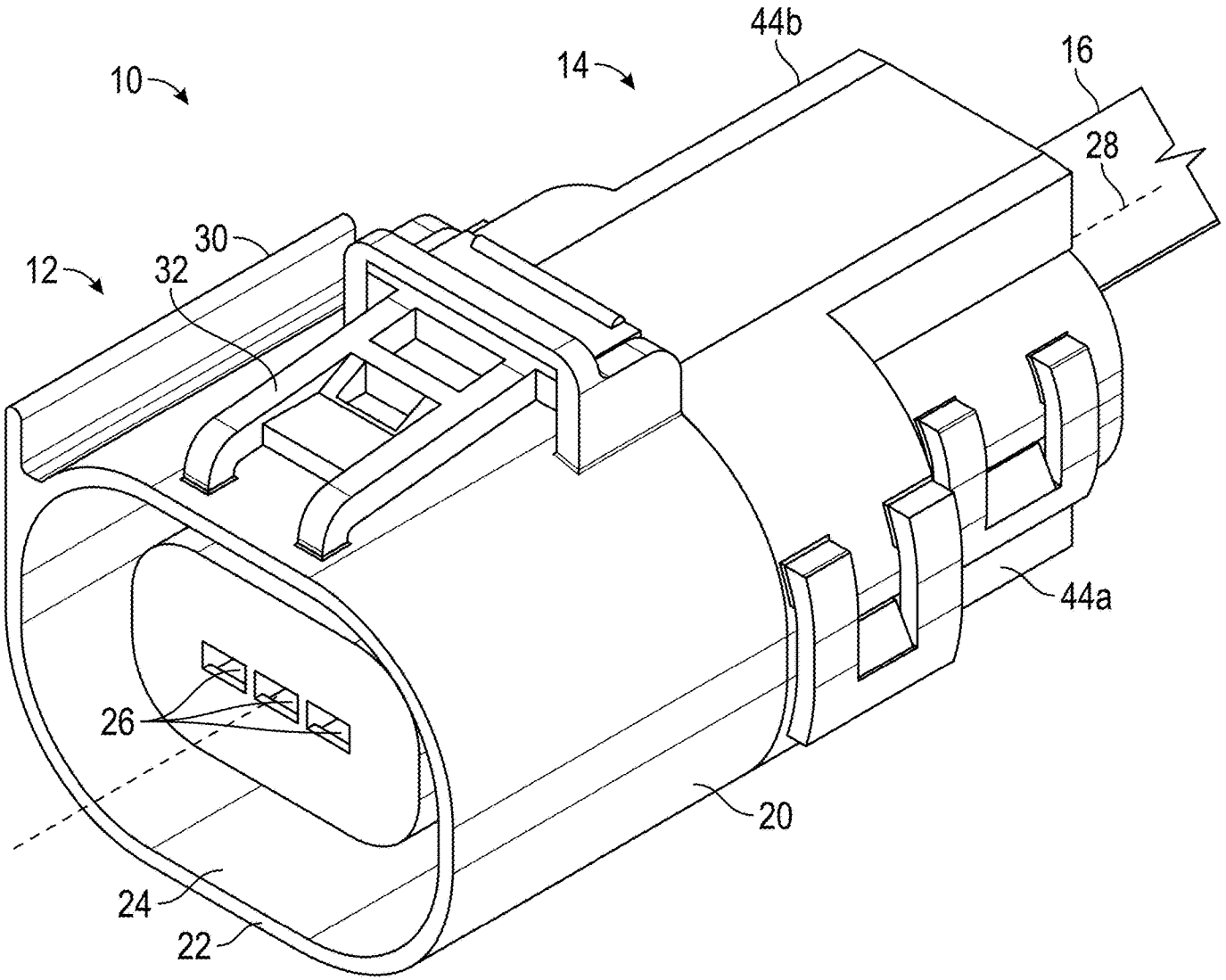
FIG. 1 is a perspective view of a front end of a split cover electrical connector in accordance with the invention.
Figure 2:
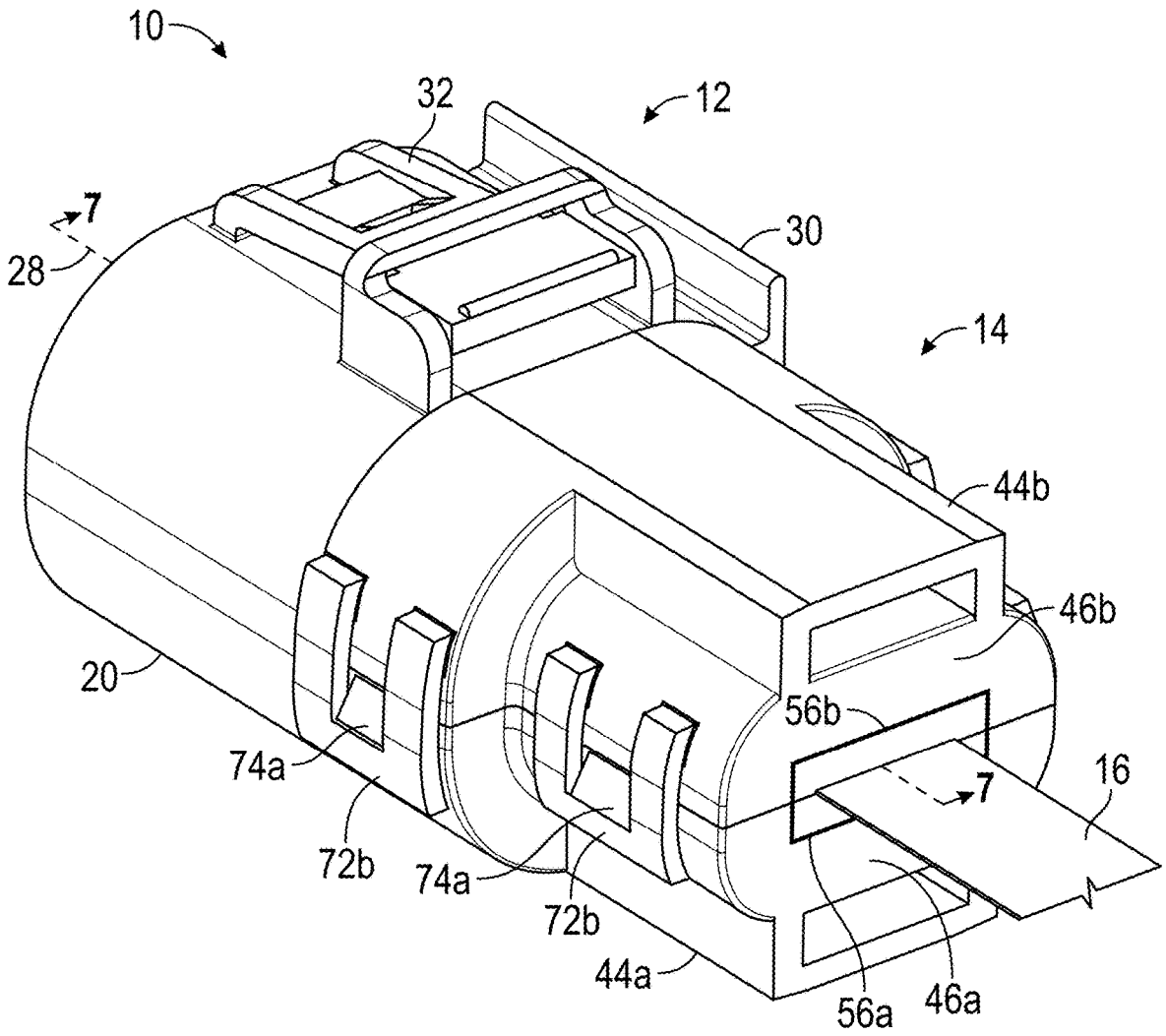
FIG. 2 is a perspective view of a rear end of the split cover electrical connector shown in FIG. 1.

Referring now to the drawings, there is illustrated in FIGS. 1 and 2 a split cover electrical connector, indicated generally at 10. FIG. 1 is a perspective view of the split cover electrical connector 10 from the front and FIG. 2 is a perspective view of the split cover electrical connector 10 from the rear. The split cover electrical connector 10 includes a contact portion 12 that is adapted to engage a corresponding electrical connector (not shown) and a cable portion 14 that is adapted to engage a cable 16. The illustrated cable 16 is a flat flexible cable, but may be any desired type of cable.

Figure 3:
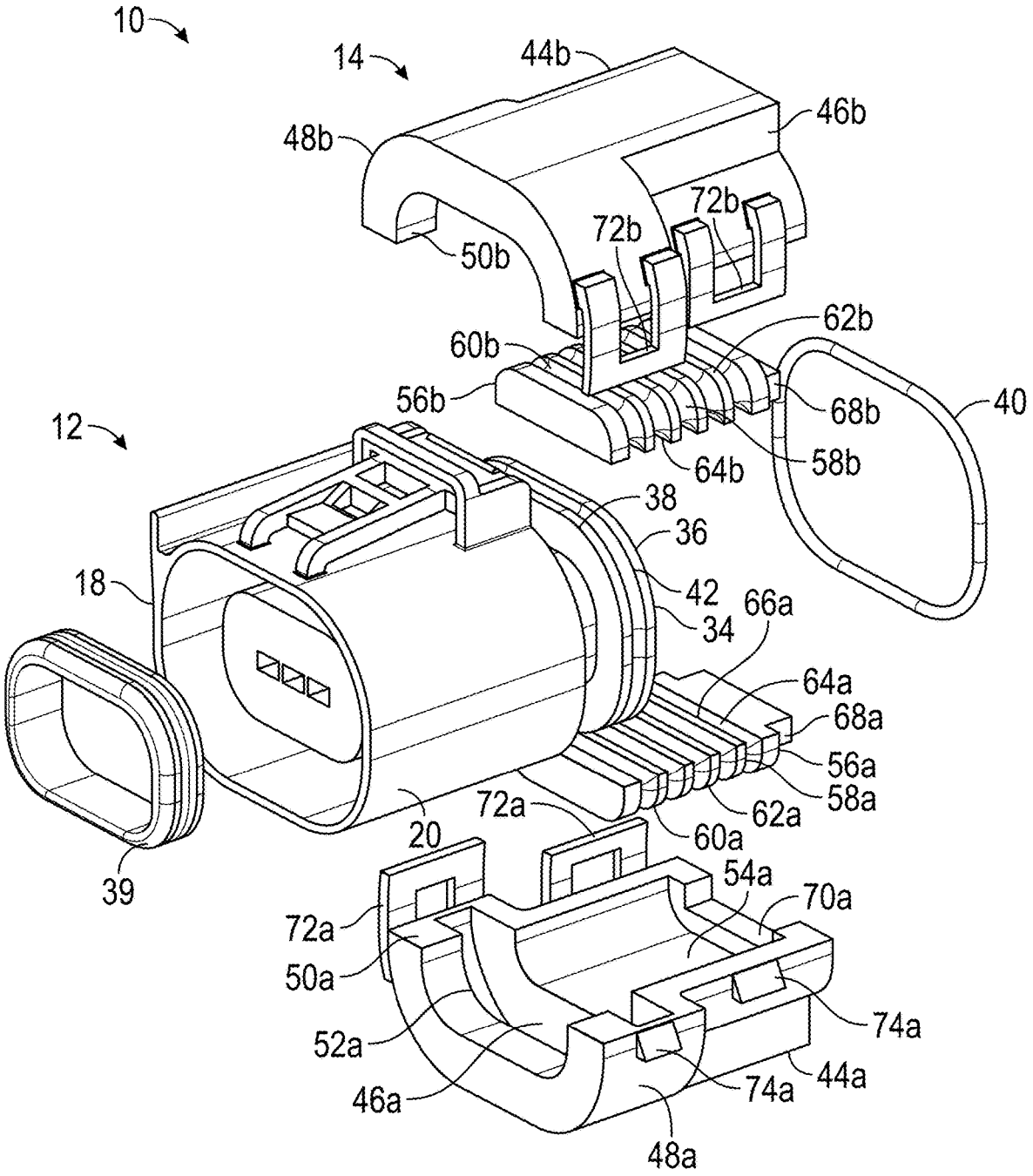
FIG. 3 is an exploded perspective view of the front end of the split cover electrical connector shown in FIGS. 1 and 2.

FIG. 3 is an exploded perspective view of the split cover electrical connector 10. The split cover electrical connector 10 includes a connector housing 18. The illustrated housing 18 is molded from plastic, but may be made from any desired material and by any desired process. The housing 18 includes a housing body 20. A shroud 22 extends from the housing body 20 and defines a connector space 24. When the split cover electrical connector 10 is mated with the corresponding electrical connector, at least a portion of the corresponding electrical connector is located in the connector space 24. The housing 18 includes terminal cavities 26 that open into the connector space 24. The illustrated housing 18 includes three terminal cavities 26, but may include any desired number of terminal cavities 26. The terminal cavities 26 extend parallel to a connector axis 28.

The split cover electrical connector 10 includes a polarizer 30 that extends from the housing body 20. The polarizer 30 is adapted to limit the orientation of the split cover electrical connector 10 relative to the corresponding electrical connector when the two are mated. The split cover electrical connector 10 also includes a connector latch 32 that is part of the housing 18. The connector latch 32 is adapted to engage the corresponding electrical connector in order to retain the split cover electrical connector 10 in a mated position relative to the corresponding electrical connector.

The housing 18 includes a cover mount 34 that extends from the housing body 20. The illustrated cover mount 34 extends from the housing body 20 in a direction parallel to the connector axis 28, but the cover mount 34 may extend from the housing body 20 in any desired direction. The cover mount 34 includes a housing flange 36 and a housing groove 38 that is located between the housing flange 36 and the housing body 20. The housing flange 36 extends generally perpendicular to the connector axis 28, but may extend in any desired direction. The purpose of the cover mount 34 will be described below.

The split cover electrical connector 10 includes a connector seal 39. The illustrated connector seal 39 is a ring made of an elastomeric material, but may be made of any desired material. The connector seal 39 is located in the connector space 24 when the split cover electrical connector 10 is assembled. The split cover electrical connector 10 also includes a cover seal 40. The illustrated cover seal 40 is also a ring made of an elastomeric material, but may have any desired shape and be made of any desired material. The cover mount 34 includes a seal seat 42 located on the housing flange 36. The seal seat 42 is a generally U-shaped groove on an outer surface of the housing flange 36, and the cover seal 40 is located in the seal seat 42 when the split cover electrical connector 10 is assembled.

The split cover electrical connector 10 also includes a first cover 44*a* and a second cover 44*b*. The illustrated split cover electrical connector 10 includes two covers 44*a* and 44*b*, but may include any desired number of covers 44*a* and 44*b*. Both the first cover 44*a* and the second cover 44*b* are molded from plastic, but may be made of any desired material and by any desired process. In the illustrated embodiment, the first cover 44*a* and the second cover 44*b* have identical shapes, with the second cover 44*b* rotated 180-degrees around the connector axis 28 from the first cover 44*a*. However, the first cover 44*a* and the second cover 44*b* may have different shapes, if desired. In this description and drawings, parts of the first cover 44*a* are identified with the suffix "a" and similar parts of the second cover 44*b* are identified with the suffix "b."

The first cover 44*a* includes a cover body 46*a* and a housing mount 48*a* that extends from the cover body 46*a*. The illustrated housing mount 48*a* extends from the cover body 46*a* in a direction parallel to the connector axis 28, but the housing mount 48*a* may extend from the cover body 46*a* in any desired direction. The housing mount 48*a* includes a cover flange 50*a* and a cover groove 52*a* that is located between the cover flange 50*a* and the cover body 46*a*. The cover flange 50*a* extends generally perpendicular to the connector axis 28, but may extend in any desired direction. The cover flange 50*a* is adapted to fit at least in part within the housing groove 38 on the housing 18. Additionally, the housing flange 36 is adapted to fit at least in part within the cover groove 52*a*.

The first cover 44*a* includes a cable seal seat 54*a* that is defined in the cover body 46*a*. The cable seal seat 54*a* is adapted to accommodate a first cable seal 56*a*. Similarly, the second cover 44*b* includes a cable seal seat (not shown) that is adapted to accommodate a second cable seal 56*b*.

Both the first cable seal 56*a* and the second cable seal 56*b* are made from an elastomeric material, but may be made of any desired material and by any desired process. In the illustrated embodiment, the first cable seal 56*a* and the second cable seal 56*b* have identical shapes, with the second cable seal 56*b* rotated 180-degrees around the connector axis 28 from the first cable seal 56*a*. However, the first cable seal 56*a* and the second cable seal 56*b* may have different shapes, if desired. In this description and the drawings, parts of the first cable seal 56*a* are identified with the suffix "a" and similar parts of the second cable seal 56*b* are identified with the suffix "b."

The first cable seal 56*a* includes a seal body 58*a* which has a cover surface 60*a*. In FIG. 3, the cover surface 60*b* on second cable seal 56*b* is more visible. When the split cover electrical connector 10 is assembled and the first cable seat 56*a* is positioned in the cable seal seat 54*a*, the cover surface 60*a* is engaged with the first cover 44*a*. The first cable seal 56*a* includes a plurality of cover channels 62*a* that extend across the cover surface 62*a*, generally perpendicular to the connector axis 28. The first cable seal 56*a* also has a cable surface 64*a* that is on an opposite side of the seal body 58*a* from the cover surface 60*a*. The first cable seal 56*a* includes a plurality of cable channels 66*a* that extend across the cable surface 64*a*, generally perpendicular to the connector axis 28. In the illustrated embodiment, the cover channels 62*a* and the cable channels 66*a* meet to provide continuous channels around the entire seal body 58*a*. However, the cover channels 62*a* and the cable channels 66*a* may have any desired arrangement, relative size, and spacing.

The first cable seal 56*a* includes a tail 68*a* that extends from the seal body 58*a* generally parallel to the connector axis 28. The tail 68*a* has a smaller cross-sectional shape, when viewed perpendicular to the connector axis 28, than the seal body 58*a*. The tail 68*a* is adapted to be positioned in a tail seat 70*a* on the first cover 44*a* to properly position the first cable seal 56*a* relative to the first cover 44*a*.

The first cover 44*a* includes a plurality of cover latches 72*a*. The first cover 44*a* includes two cover latches 72*a*, but may include any desired number of cover latches 72*a*. The first cover 44*a* also includes a plurality of cover catches 74*a*. The first cover 44*a* includes two cover catches 74*a*, but may include any desired number of cover catches 74*a*. The function of the cover latches 72*a* and the cover catches 74*a* will be described below.

Figure 4:
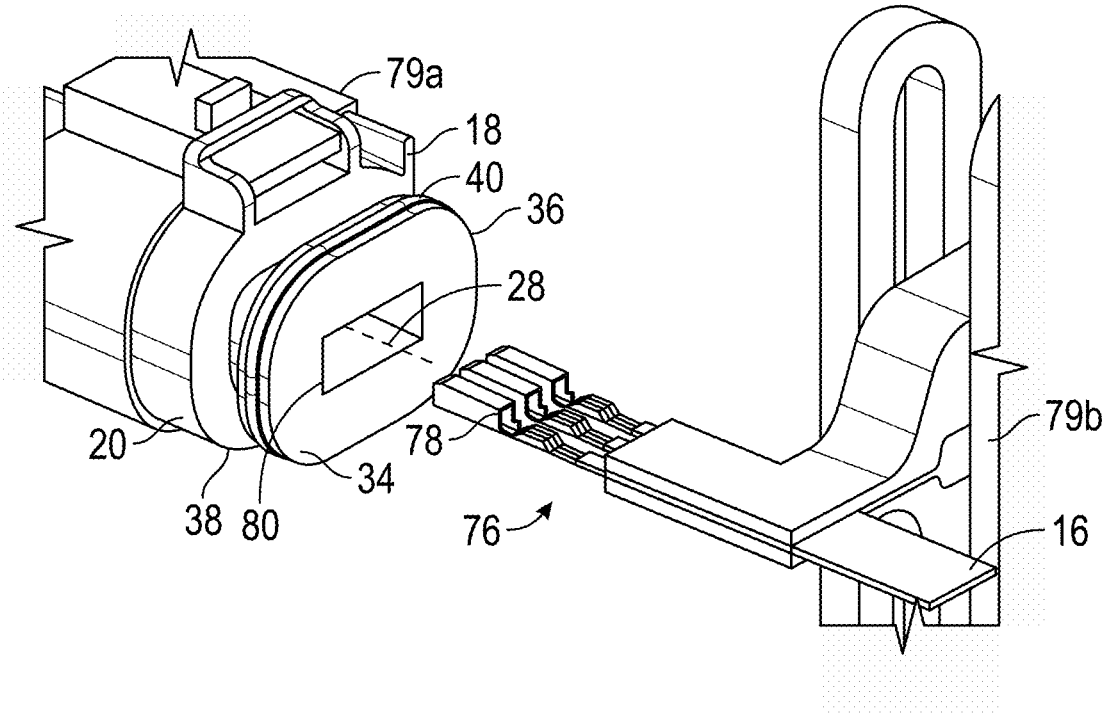
FIG. 4 is a perspective view of the partially assembled split cover electrical connector shown prior to insertion of a flat flexible cable.

Referring to FIG. 4, there is illustrated a perspective view of the housing 18 and a cable assembly, indicated generally at 76. The cable assembly 76 includes the flat flexible cable 16 and three electrical terminals 78 that are attached to the flat flexible cable 16. The illustrated electrical terminals 78 are crimped onto the flat flexible cable 16, but may be attached using any desired method. The illustrated electrical terminals 78 are female terminals, but may be any desired type of terminal. In FIG. 4, the cable assembly 76 is shown prior to the electrical terminals 78 being inserted into the terminal cavities 26 (which are shown in FIG. 3). Also shown in FIG. 4 is a housing retainer 79*a* and a portion of an assembly robot 79*b*. In the illustrated embodiment, during assembly of the split cover electrical connector 10, the housing 18 is held by the housing retainer 79*a*, and the assembly robot 79*b* moves the cable assembly 76 relative to the housing 18. However, the split cover electrical connector 10 may be assembled manually or by any other desired method. The housing 18 includes a single cable cavity 80 that extends through the housing mount 48*a* generally parallel to the connector axis 28. The cable cavity 80 is in communication with the terminal cavities 26 inside the housing body 20. As shown, the cover seal 40 is located in the seal seat 42 prior to the electrical terminals 78 being inserted into the terminal cavities 26.

Figure 5:
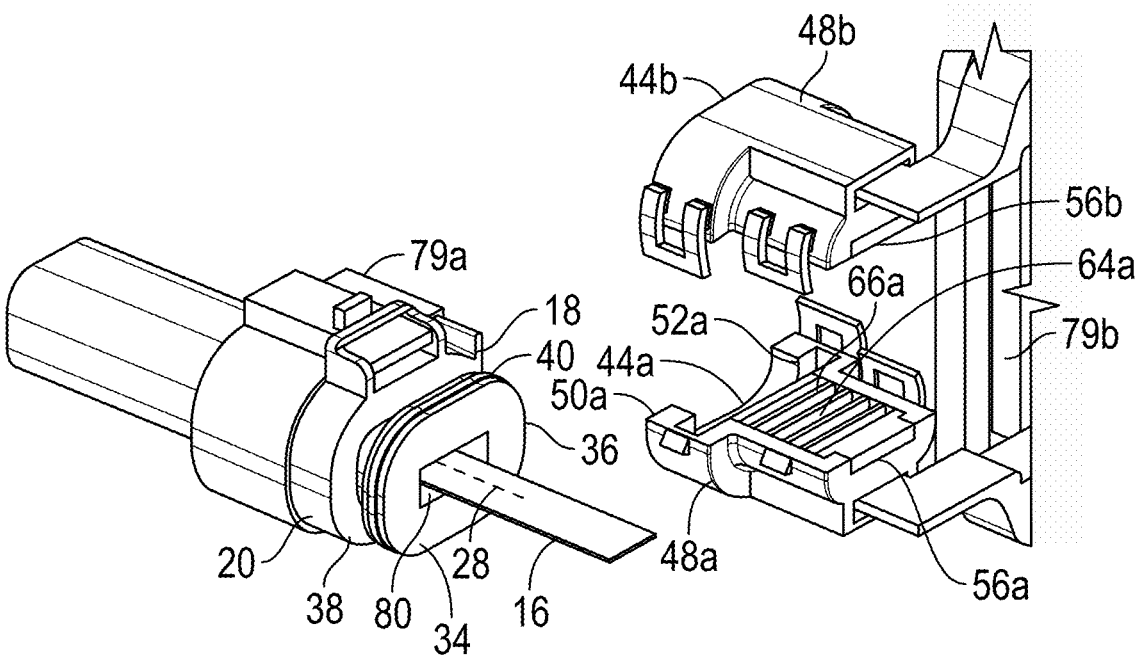
FIG. 5 is a perspective view similar to FIG. 4 showing the flat flexible cable after being inserted into a terminal cavity in a housing of the split cover electrical connector and prior to the installation of first and second covers.
Figure 6:
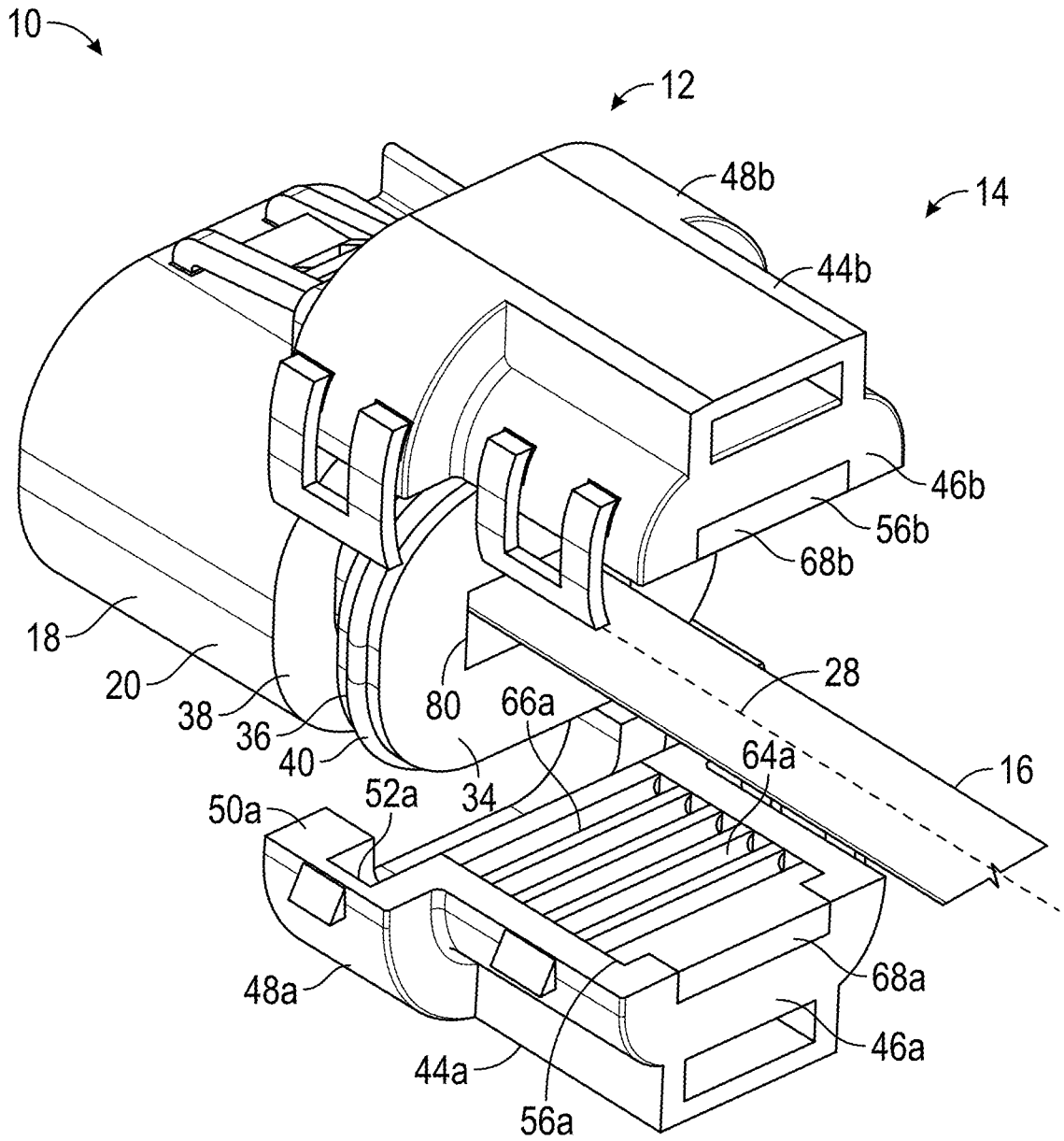
FIG. 6 is a perspective view similar to FIG. 5 showing the first and second covers positioned to be attached to the housing.

FIG. 5 is a view similar to FIG. 4, with the cable assembly 76 shown inserted into the cable cavity 80. The electrical terminals 78 (not visible in FIG. 5) can be retained in respective terminal cavities 26 by any desired lock mechanism. Also shown, the first cable seal 56*a* is located in the cable seal seat 54*a* on the first cover 44*a*, and the second cable seal 56*b* is located in the cable seal seat 54*b* on the second cover 44*b*. The first cover 44*a* and the second cover 44*b* are positioned on opposite sides of the connector axis 28 and on opposite sides of the flat flexible cable 16, with the cable surfaces 64*a* and 64*b* facing the flat flexible cable 16.

Referring back to FIG. 2, the split cover electrical connector 10 is shown assembled with the cable assembly 76. As shown, the first cover 44*a* is engaged with the second cover 44*b*, and each cover catch 74*a* on the first cover 44*a* is engaged by a respective cover latch 72*b* on the second cover 44*b*. Similarly, though not visible in FIG. 2, each cover catch 74*b* on the second cover 44*b* is engaged by a respective cover latch 72*a* on the first cover 44*a*. This retains the first cover 44*a* in the illustrated position relative to the second cover 44*b*. As previously described, the housing flange 36 is adapted to fit (at least in part) within the cover groove 52*a*, while the cover flange 50*a* and the cover flange 50*b* are adapted to fit at least in part within the housing groove 38. This retains the assembly of the first cover 44*a* and the second cover 44*b* in position relative to the housing 18.

Figure 7:
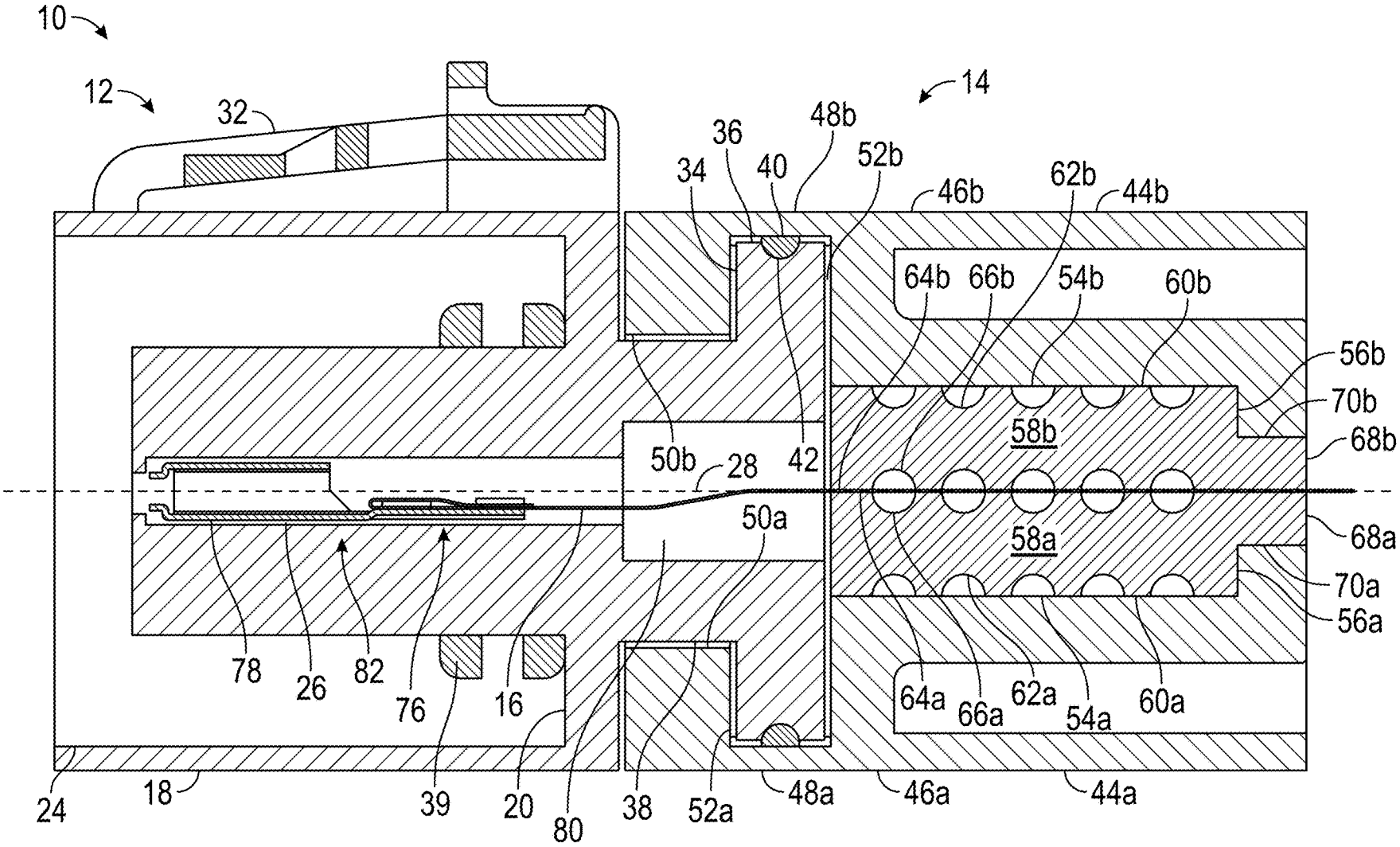
FIG. 7 is a cross-sectional view taken along line 7-7 of FIG. 2.

FIG. 7 is a cross-sectional view of the split cover electrical connector 10 taken along line 7-7 of FIG. 2. One of the electrical terminals 78 is shown positioned in one of the terminal cavities 26. The cable 16 extends from the terminal cavity 26 into the cable cavity 80 and between the first cable seal 56*a* and second cable seal 56*b*. A portion of the flat flexible cable 16 is located between the first cable seal 56*a* and second cable seal 56*b*. As shown in FIG. 2, the first cable seal 56*a* is engaged with the second cable seal 56*b* and the cable surface 64*a* is engaged with the cable surface 64*b*. As best shown in FIG. 7, a portion of the flat flexible cable 16 is located between the cable surface 64*a* and the cable surface 64*b*. Also, the cover seal 40 is located in the cover grooves 52*a* and 52*b*.

The cover seal 40 is compressed between the connector housing 18 and the first cover 44*a* and is also compressed between the connector housing 18 and the second cover 44*b*. As previously described, when the split cover electrical connector 10 is mated with the corresponding electrical connector, at least a portion of the corresponding electrical connector is located in the connector space 24. The connector seal 39 is adapted to engage the corresponding electrical connector. When the split cover electrical connector 10 is mated with the corresponding electrical connector, the connector seal 39, the cover seal 40, the first cable seal 56*a*, and the second cable seal 56*b* are adapted to provide a sealed space, indicated generally at 82. The sealed space 82 includes the terminal cavities 26 and the cable cavity 80. The electrical terminals 26 are located in the sealed space 82.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a housing including a housing body and a cover mount having a cable cavity;

a first cover including a first cable seal; and a second cover including a second cable seal;

wherein the first cover engages the second cover to retain the first cover in position relative to the second cover, and wherein the first cover and the second cover engage the cover mount to retain the first cover and the second cover in position relative to the housing.

2. The electrical connector of claim 1, wherein the first cable seal is engaged with the second cable seal.

3. The electrical connector of claim 1, wherein the first cable seal includes a cable surface with cable channels that extend across the cable surface.

4. The electrical connector of claim 3, wherein the second cable seal includes a second cable surface with cable channels that extend across the second cable surface.

5. The electrical connector of claim 1, wherein the cover mount includes a housing flange and a housing groove located between the housing flange and the housing body.

6. The electrical connector of claim 5, wherein the first cover includes a cover flange that is located at least in part in the housing groove.

7. The electrical connector of claim 6, wherein the second cover includes a cover flange that is located at least in part in the housing groove.

8. The electrical connector of claim 1, wherein the first cover and the second cover respectively include a cover latch and a cover catch that engage one another to retain the first cover and the second cover in position relative to each other.

9. The electrical connector of claim 8, wherein the cover mount includes a housing flange and a housing groove located between the housing flange and the housing body.

10. The electrical connector of claim 9, wherein the first cover includes a cover flange that is located at least in part in the housing groove.

11. The electrical connector of claim 10, wherein the second cover includes a cover flange that is located at least in part in the housing groove.

12. The electrical connector of claim 1, wherein the first cover includes a cover groove, and wherein the cover mount includes a housing flange that is located at least in part in the cover groove.

13. The electrical connector of claim 12, wherein the housing includes a housing groove, and wherein the first cover includes a cover flange that is located at least in part in the housing groove.

14. The electrical connector of claim 13, wherein the cover flange is located between the housing flange and the housing body.

15. The electrical connector of claim 1, further including a cable assembly that is retained in the housing and is located at least in part between the first cover and the second cover.

16. The electrical connector of claim 15, wherein the first cable seal is attached to the first cover, the second cable seal is attached to the second cover, the first cable seal is engaged with the cable assembly, and the second cable seal is engaged with the cable assembly.

17. An electrical connector comprising:

a housing with a housing body, a cover mount with a housing flange and a housing groove located between the housing flange and the housing body, and a cable cavity;

a first cover with a first cover flange and a first cable seal; and a second cover with a second cover flange and a second cable seal;

wherein the first cover engages the second cover to retain the first cover in position relative to the second cover, and wherein the first cover flange and the second cover flange are located at least in part in the housing groove.

18. The electrical connector of claim 17, wherein:

the first cable seal is attached to the first cover, the second cable seal is attached to the second cover, a cable assembly is retained in the housing and is located at least in part between the first cover and the second cover, the first cable seal is engaged with the cable assembly, and the second cable seal is engaged with the cable assembly.

19. An electrical connector comprising:

a housing with a housing body, a cover mount with a housing flange and a housing groove located between the housing flange and the housing body, and a cable cavity;

a first cover with a first cover flange and a first cable seal;

a second cover with a second cover flange and a second cable seal; and a cable that is located in part in the cable cavity and extends between the first cover and the second cover;

wherein the first cover engages the second cover to retain the first cover in position relative to the second cover and wherein the first cover flange and the second cover flange are located at least in part in the housing groove.

20. The electrical connector of claim 19, wherein:

the first cable seal is attached to the first cover, the second cable seal is attached to the second cover, the first cable seal is engaged with the cable assembly, and the second cable seal is engaged with the cable assembly.

* * * * *